US009902475B2

(12) United States Patent
Waldrop

(10) Patent No.: US 9,902,475 B2
(45) **Date of Patent: *Feb. 27, 2018**

(54) METHODS, SYSTEMS, AND DEVICES FOR MANAGING MOORING SITES

(71) Applicant: Susan Waldrop, Vineyard Haven, MA (US)

(72) Inventor: Susan Waldrop, Vineyard Haven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/589,669

(22) Filed: May 8, 2017

(65) Prior Publication Data

US 2017/0240255 A1 Aug. 24, 2017

Related U.S. Application Data

(63) Continuation-in-part of application No. 14/272,822, filed on May 8, 2014, now Pat. No. 9,643,688.

(60) Provisional application No. 61/855,090, filed on May 8, 2013.

(51) Int. Cl.

| | |
|---|---|
| ***G08G 3/00*** | (2006.01) |
| ***B63B 45/02*** | (2006.01) |
| ***F21V 23/02*** | (2006.01) |
| ***F21V 23/04*** | (2006.01) |
| ***B63B 22/02*** | (2006.01) |
| *F21W 111/047* | (2006.01) |
| *F21Y 115/10* | (2016.01) |

(52) U.S. Cl.

CPC ..... *B63B 45/02* (2013.01); *B63B 22/02* (2013.01); *F21V 23/026* (2013.01); *F21V 23/0407* (2013.01); *F21V 23/0435* (2013.01); *F21W 2111/047* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2,104,762 A * | 1/1938 | Riner | B63B 51/04 | 200/52 R |
| 2,300,795 A * | 11/1942 | McAllister | B63C 9/21 | 200/52 A |
| 2,355,013 A * | 8/1944 | Rochestle | B63B 51/04 | 200/232 |
| 3,453,670 A | 7/1969 | Conry | | |
| 3,953,905 A | 5/1976 | Paitson | | |
| 4,099,282 A * | 7/1978 | Townsend | B63C 9/21 | 441/16 |

(Continued)

OTHER PUBLICATIONS

Vega Industries Ltd., VLB-67 LED Marine Beacon, Short Range Beacon 2-5NM at 0.741/2.25-6NM at 0.85T, Dec. 10, 2013, p. 1-4, Vega Industries Ltd., Porirua, New Zealand.

(Continued)

*Primary Examiner* — Julie Lieu

(74) *Attorney, Agent, or Firm* — Hayes Soloway PC

(57) ABSTRACT

A remote controlled lighted mooring beacon is adapted to be secured to a mooring site. The beacon may include various features, such as a central shaft, a ballast at the base of the shaft containing at least one power source, a float, an electronics package having a receiver that responds to a wireless code for generating an activation signal, and a 360 degree viewable high intensity light source.

18 Claims, 8 Drawing Sheets

(56) References Cited

U.S. PATENT DOCUMENTS

| | | | | | |
|---|---|---|---|---|---|
| 4,763,126 | A * | 8/1988 | Jawetz | G08G 3/00 | 340/985 |
| 4,896,620 | A * | 1/1990 | Jones | B63B 51/02 | 114/253 |
| 5,284,452 | A * | 2/1994 | Corona | B63B 22/026 | 114/230.21 |
| 5,890,794 | A * | 4/1999 | Abtahi | B60Q 7/00 | 362/183 |
| 8,127,702 | B2 * | 3/2012 | Scarcello | B63B 22/02 | 114/221 R |
| 8,602,584 | B2 * | 12/2013 | Ghafoori | H05B 37/0272 | 315/154 |
| 2011/0304480 | A1 * | 12/2011 | Doria | B63B 22/02 | 340/984 |
| 2012/0294014 | A1 * | 11/2012 | Harwood | F21S 2/00 | 362/311.06 |
| 2012/0326882 | A1 * | 12/2012 | Behm | G01S 1/70 | 340/686.6 |
| 2014/0071681 | A1 * | 3/2014 | Ghafoori | F21V 33/0076 | 362/249.14 |
| 2014/0218900 | A1 * | 8/2014 | Adair | F21S 9/037 | 362/183 |
| 2017/0122536 | A1 * | 5/2017 | Noga | F21V 21/36 | |

OTHER PUBLICATIONS

Sealite, Products for Inland Waterways, http://www.sealite.cormau/sealite_inland_waterways_products.php.

* cited by examiner

METHODS, SYSTEMS, AND DEVICES FOR MANAGING MOORING SITES

RELATED APPLICATIONS

This Application is a Continuation-in-Part Application of U.S. application Ser. No. 14/272,822, filed May 8, 2014, which claims rights under 35 USC § 119(e) from U.S. Application Ser. No. 61/855,090 filed May 8, 2013, the contents of which are incorporated herein by reference.

FIELD

This disclosure relates to moorings and more particularly to a method and apparatus for locating a mooring by illuminating a high power light source atop the mooring. In some embodiments, the light source is able to be activated wirelessly by a controller used by a manager of the mooring area (e.g., the harbor master, marina owner, yacht club manager, etc.). In these and other embodiments, a user of a mooring site may also be able to wirelessly activate the light source atop a designated mooring site (e.g., by using a remote control transponder device and/or an application on a mobile computing device).

BACKGROUND

It will be appreciated that sailing vessels such as sailboats and motorboats require a mooring or boat slip to attach to when coming into port. Leaving a mooring is not an issue, but finding a mooring again or finding a guest mooring at the end of a boating event is oftentimes problematic. Moorings may be marked by color, number or by other indicia. However, regardless of how the mooring is marked, it may not be viewable from a distance or may be obscured by fog or other boats in the area.

In broad daylight, even experienced sailors or boaters who have identified their mooring location before departure can find it difficult to find the mooring after a race. For example, the indicia may be rotated away from view, or other boats may have moved, or the line-up with a land marker may have shifted. The problem of locating a mooring happens in a field as small as about 30 moorings. Add to this basic dilemma a heavy breeze, a few extra boats all searching for their mooring, particularly as they all come in after a race, a larger more crowded mooring field, and there could be collisions from boats tacking in close quarters, all trying to find their moorings.

For instance, in Marblehead Harbor alone there are 2600 moorings, with the boats moored side-by-side with very little maneuvering room. When coming into the harbor it is oftentimes not possible to even see the mooring for which one is headed and certainly not to be able to identify it at any distance. This is even further complicated by fog or in driving rain such that it is oftentimes impossible to locate the correct mooring buoy. In such a situation ordinarily a boat has to circle the mooring field a number of times in order to be able to identify the correct mooring.

Some prior systems for indicating buoy location by lights atop the buoy are designed for buoys that carry large heavy battery packs recharged with wave action and are totally unsuitable for use as mooring sticks common with recreational boating moorings. These buoys are difficult to remove from the water at the end of the season and difficult to waterproof. Other prior systems for indicating mooring location by lights atop the mooring are designed to be powered by solar cell arrays. It will be appreciated that solar cells used to power illuminated buoys are too unwieldy to be conveniently plucked from the water. Other recreational boating devices that require wave action energy are simply too cumbersome for use on seasonal mooring sticks. Further, prior art lighted mooring sticks lack an adequate counterweight for keeping the stick upright.

For instance the system described in U.S. Pat. No. 4,763,126 does not carry the power source at the base of the mooring stick but rather locates the apparatus for powering the light in the buoyant central package midway up the mooring stick and thus provides no ballasting. U.S. Pat. No. 4,903,243 requires a rechargeable battery which either requires solar cells or wave action to recharge the battery. This type of system precludes its use on a mooring stick.

It will be appreciated that long life for a lighted mooring beacon is important so that it can last an entire boating season without power source replacement. This is because access to the mooring is not convenient in many instances and power source replacement (e.g., replacing or recharging batteries or a different power source) is a nuisance. This power problem is particularly severe when one attempts to utilize a high intensity strobe light to identify the position of a mooring stick. Without a significant power source that can operate for a whole boating season, strobe-based systems are not useful in mooring beacons.

It is therefore important to provide a mooring beacon with a very high intensity 360° viewable light source on top of a mooring stick that can be viewed from far away and yet has enough power in reserve so that the mooring beacon can be installed and used for entire boating season.

SUMMARY OF THE INVENTION

The subject methods, systems, and devices address the above-mentioned problems by providing a remote-controlled mooring beacon having a 360 degree viewable high intensity light source atop a mooring beacon. As described below, in detail, the mooring beacons described herein may be affixed to any suitable structure, including but not limited to mooring balls, mooring sticks, fixed docks, floating docks, piers, buoys, and/or mooring pilings. In cases where the mooring beacon is also used as a mooring stick, the mooring stick may be ballasted by a power source (e.g., a battery pack) at its lower end, with the power source being of sufficient size to last an entire boating season. The power source may also have sufficient weight to provide enough ballast so that the mooring beacon stays upright even in heavy seas. Note the entire mooring beacon may be waterproof, in some embodiments. The subject mooring beacon may allow the boat owner to plan his approach to the mooring field with sufficient time to prevent dangerous, quick and unexpected turns in tight places, with the mooring beacon seen easily. More particularly, the power source can replace the traditional lead weight at the bottom of a mooring stick. With a heavy power source (in some embodiments, batteries) at the base of the mooring beacon and with a buoyant float in the middle portion, the large power source permits not only season-long powering of a very high intensity light source for identifying the location of the mooring beacon, but also provide ballasting of the mooring stick even in heavy seas. In one embodiment, the power source weighs at least two pounds. In some particular embodiments, the power source weighs approximately 4-5 pounds. The mooring beacon itself may have any desired dimensions. In some embodiments, for example, the mooring beacon is between 3 and 6 feet in length. In some embodiments, the mooring beacon extends approximately 3-7 feet above the buoyant float and approximately 1-3 feet below the buoyant float.

The light atop the mooring beacon is a powerful 360 degree-viewable light source which may be turned on by wireless signals transmitted to a receiver on the mooring beacon. Wireless signals can be transmitted to the mooring beacon receiver using any suitable device, including but not limited to remote control transponders and/or mobile computing device applications. In some particular embodiments, a remote control transponder or mobile computing device application may be set to transmit signals having the same frequency or code assigned to the mooring beacon. In these and other embodiments, the mooring beacon may be actuatable from at least one quarter mile, half a mile, three quarters of a mile, one mile, or a greater distance away.

It will be appreciated that the high intensity light source can be any suitable light source. In some embodiments, for example, the high intensity light source may be a strobe light which is viewable, for instance, up to a mile from the mooring. Alternatively, in other embodiments, the high intensity light source can be formed from an array of LED lamps arranged in so that they point in varying directions for 360 degree coverage. If the individual LEDs are insufficiently bright to provide for the requisite illumination, multiple LEDs can be packaged in a module. These modules are then arranged to provide the required 360 degree coverage. Each of these modules may contain for instance from 3 to 20 individual LED lamps to provide for the requisite intensity. Commonly available LED lights only point in one direction and do not provide 360 degree coverage. However with multiple LEDs arranged as described above, the subject mooring beacon is readily viewable in bright sunlight, at night and in fog.

Moreover, in one embodiment, the mooring beacon receiver can be turned off completely when stored and automatically turns off the high intensity light source after a predetermined period of time to minimize power source drainage. Further, a beeping sound system can be attached as desired and timed with the flashing light source.

The disclosed mooring beacon system can also be used in any appropriate location, including fresh or salt water bodies. In some cases, the disclosed systems and devices may be used to manage mooring sites with transient users. For example, and as described in detail below, the disclosed systems may allow a mooring area manager (e.g., a harbor master, yacht club manager, marina owner) to manage various mooring sites by activating a mooring beacon associated with a particular mooring site, as desired. In some embodiments, the user of a mooring (e.g., a guest) may also be able to activate the assigned mooring beacon wirelessly using a transmitter device, such as a remote control transponder device or a mobile computing device application. In some embodiments, the manager of the mooring sites may actuate a mooring beacon upon request from a user. The user could sail or motor to the illuminated mooring beacon with assurance that he or she is finding the right mooring. In some embodiments, an application for a mobile computing device (e.g., an app) may be used to reserve a mooring site, provide payment for the mooring site, view the mooring site on a map, illuminate the beacon of the mooring site, and/or communicate with the manager of the mooring site.

In addition, the subject beacon system can be used to locate boat slips for the owner or guest so that they may safely navigate into the slip by themselves. Since many such slips look alike even to an owner, it is important to be able to identify the correct slip so that the boated can enter the correct slip.

When the mooring beacon light is placed at a slip, the beacon can be remotely activated from a mooring site manager to indicate which slip is available. When numbers of boats are coming in for dock space, only one mooring beacon is activated at a time by the mooring site manager who can selectively address the mooring beacons and then extinguish them after a boat is successfully docked. Also, the individual beacons can be either color-coded or flashed in a coded fashion to indicate to an incoming boater which slip he or she is to enter.

Additional advantages to the use of the subject device is to prevent boat collisions and in changing weather conditions and in crowded harbors. Also accidental misuse of another's mooring which requires a harbormaster to come out and a move boats off a mooring is avoided. The subject device also serves as an aid to the accurate location of moorings and boat slips. Thus the subject mooring beacon can be a valuable safety and navigational tool for the boating consumer.

In summary, a floatable remote-controllable mooring beacon is provided that incorporates either a 360 degree array of high intensity LEDS or a high-intensity flash lamp on the top of a mooring site, such as a mooring beacon used as a mooring stick, ballasted by a power source used to power the mooring beacon for the entire boating season.

BRIEF DESCRIPTION OF THE DRAWINGS

These and other features of the disclosure will be better understood in connection with the Detailed Description in conjunction with the Drawings.

DETAILED DESCRIPTION

Figure 1:
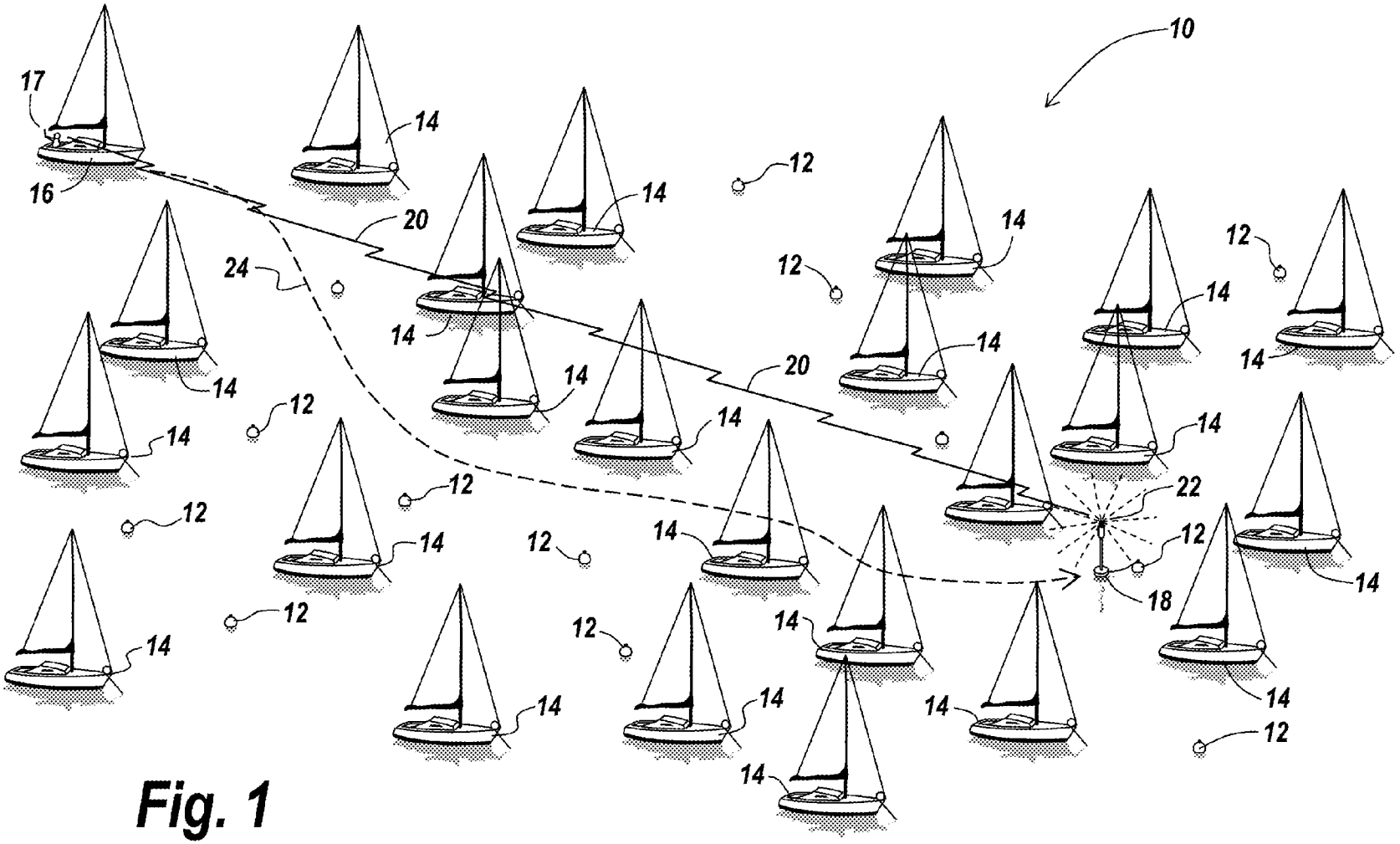
FIG. 1 is a diagrammatic illustration of the entry of a boat into a harbor searching for a mooring with an individual on the boat signaling the mooring beacon to illuminate, thereby to indicate the direction and placement of the mooring.

Referring now to FIG. 1, a crowded harbor 10 is shown having a number of mooring balls 12 located throughout the harbor to which sailing vessels 14 are moored. Although FIG. 1 and other Figures of the subject application illustrate sailboats, it is to be understood that the subject disclosure applies to any type of floating vessel, including but not limited to sailboats, motor boats, paddle boats, and other types of boats. It will be seen that due to the densely packed harbor it is very difficult for an incoming vessel 16 to be able to locate a particular mooring ball, here shown at 18, due to the number of boats in the way and due to the similarity of all of the mooring balls 12.

While the moorings themselves are numbered or provided with other indicia and while if the boater is familiar with the harbor and knows the location of boats adjacent his mooring, it is still nonetheless difficult at times for the boater to ascertain which mooring is his. The problem exacerbated when boats that usually sit around his mooring have left their moorings. Thus there is no visual cue as to which of the many moorings in the crowded mooring field is the boater's mooring.

In order for the mooring beacon 18 to be identified, a boater on a vessel 16 activates a device 17 to wirelessly activate the associated mooring beacon 18 through a transmission 20 which causes a high intensity light source 22 to illuminate. This illumination may be visible for at least 100 yards and permits the boater to maneuver his vessel as illustrated by the dotted line 24 towards his mooring beacon 18. Device 17 may be any device capable of transmitting a wireless signal, including a transponder, a mobile computing device application, or other suitable transmitter or transceiver device.

The mooring beacon 18 is of sufficient intensity and omnidirectionality that regardless of the crowding of the harbor and orientation of the mooring beacon, the mooring beacon is easily visible not only at night but also in fog and during the day.

Figure 2:
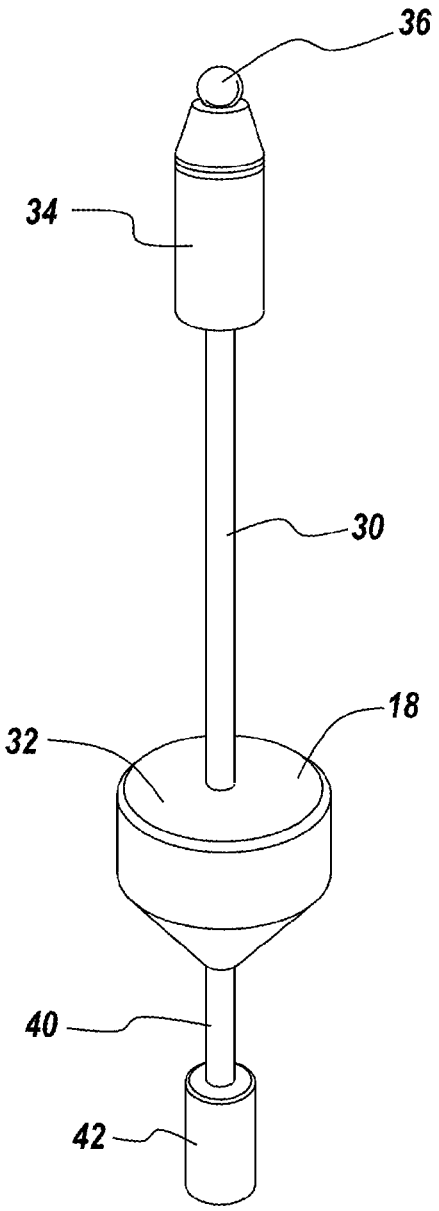
FIG. 2 is a diagrammatic illustration of the mooring beacon of FIG. 1, indicating the extension of a shaft above a float carrying a receiver package and a high-intensity light source capable of being viewed 360 degrees.

As illustrated in FIG. 2, the mooring beacon 18 is comprised of a shaft 30 that extends through a float 32 in and carries a receiver unit 34 adapted to receive the wireless signals from the wireless transmitter on a vessel entering the harbor. As used herein, the term "wireless" refers to any signal transmitted without wires, including signals transmitted using cellular, Wi-Fi, Bluetooth, ZigBee, ultra-high frequency (UHF), or near-field communication (NFC) technology. In some embodiments, wireless signal may be coded such that the only mooring beacon 18 that has its high power light source activated is the one that corresponds in code or frequency to the transmitter device actuated. On top of the receiver housing is a high intensity omnidirectional light source 36 which is visible at large distances due to the high intensity of the light source 36, be it a strobe light in one embodiment or a plurality of LEDs aimed around the compass points to provide 360° coverage. Light source 36 may be any type, frequency, or color. The bottom portion 40 of the shaft 30 is provided with a power source package 42, at times referred to herein as a "battery package," although the subject disclosure is not intended to be limited to batteries as the only type of power source. Battery package 42 can serve various functions, including powering the mooring beacon 18 and also providing a ballast to make sure that the shaft 30 is in an upright position as it floats on the surface the ocean or lake. In some embodiments, light source 36 may be powered by a source other than battery package 42. For example, in some embodiments, light source 36 may be powered by solar, wind, fuel cell, and/or shore power energy.

Figure 3:
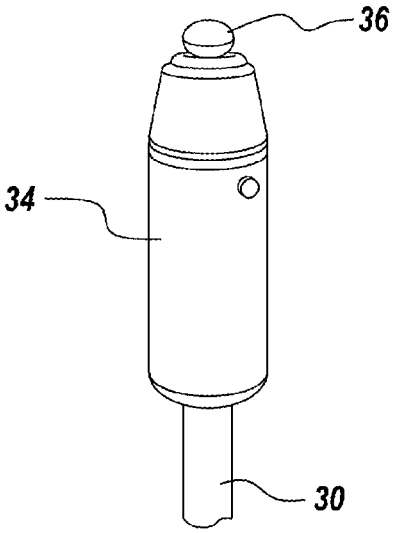
FIG. 3 is a diagrammatic illustration of the top portion of the mooring beacon of FIG. 2 illustrating the encapsulation of a receiver and the placement of a high intensity strobe light atop the shaft.

Referring to FIG. 3, the upper portion of the mooring beacon 18 of FIG. 2 is shown in which at the top of the shaft 30 is a waterproof housing 34 which carries a receiver for receiving coded signals from a wireless transmitter device. Housing 34 also includes switching circuits for connecting the power from the battery package 42 carried at the base of the shaft 30 to both the receiver within housing 34 and also to the high intensity light source 36 which is illustrated as a flash lamp strobe. The receiver may be a conventional receiver such as found in garage door openers along with conventional switches normally used in such applications.

It be appreciated that the housing and all components are made waterproof so that they will operate at least for a season and longer. The components may be hermetically sealed.

Referring back to FIG. 2, in one embodiment, the shaft 30 and attendant hardware performs the function of a mooring stick which is attached to a mooring ball by a chain. After the boater identifies his mooring and comes up to it, he may pluck the mooring stick out of the water and secure the mooring ball to a bow cleat. It is important to note that the weight of the entire mooring with shaft 30, high intensity light source 36, receiver 34 and battery package 42 may be less than 10 pounds, in some embodiments. In other embodiments, however, the mooring device may weigh approximately 10 pounds or may weigh more than 10 pounds, such as 10.5 pounds or 11 pounds. In some embodiments, the mooring device may be light enough to be easily brought aboard a boat.

Figure 4:
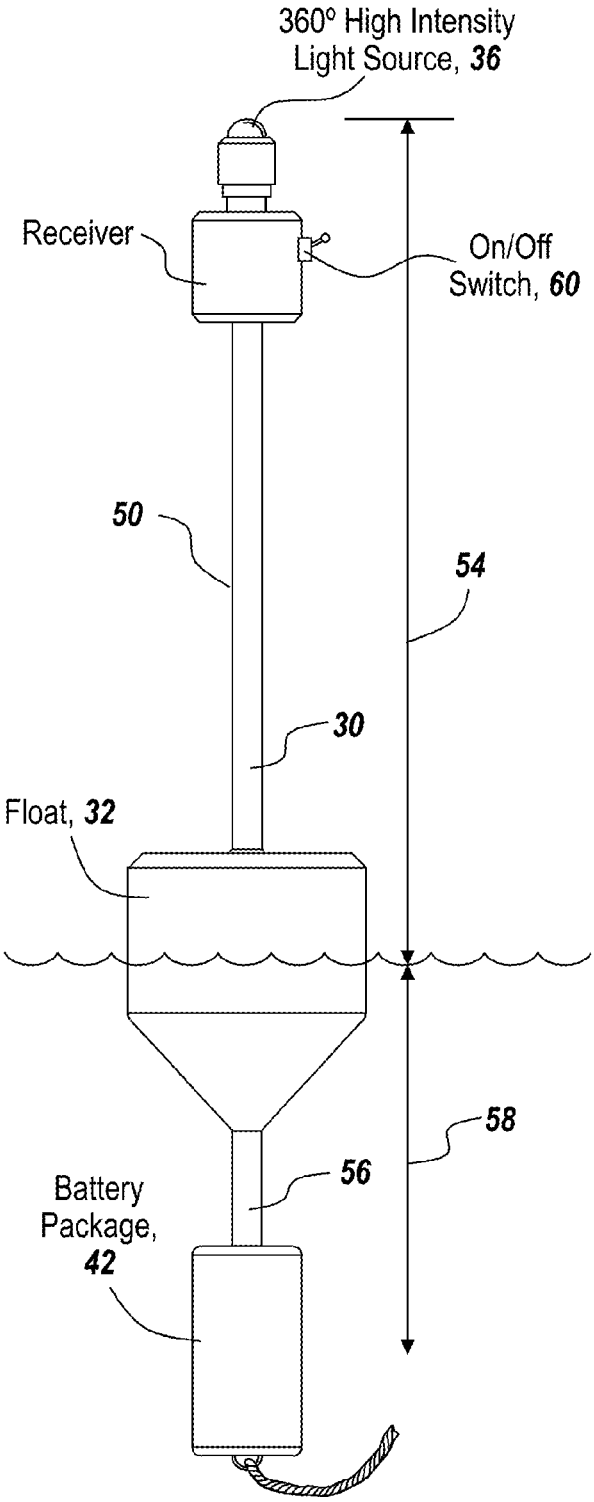
FIG. 4 is a diagrammatic illustration showing the utilization of a power source (e.g., a battery package) to ballast the mooring beacon of FIG. 1, with the shaft being utilized as a mooring stick and having a float and the receiver/light assembly on the shaft, showing the relative length of the shaft extending below the float and the relative length of the shaft extending above the float, thus to raise up the high intensity light source to give maximal visibility for the beacon while at the same time providing an appropriate righting moment for the mooring beacon due to the power source at the bottom of the shaft.

More particularly, and referring now to FIG. 4, the shaft 30 is shown to pass through the float 32 such that an upper portion 50 extends upwardly from the float 32 by a distance illustrated by arrow 54 of approximately 3 feet in one embodiment. Beneath the float is a portion of the shaft 56 having a battery package 42 secured to the distal end of shaft 30, with shaft portion 56 extending as illustrated by arrow 58 1 to 2 feet below the float 32. In one embodiment, the weight of the battery package is between 4 and 10 pounds to give sufficient righting moment to the mooring such that it remains upright in all sea conditions.

Figure 7:
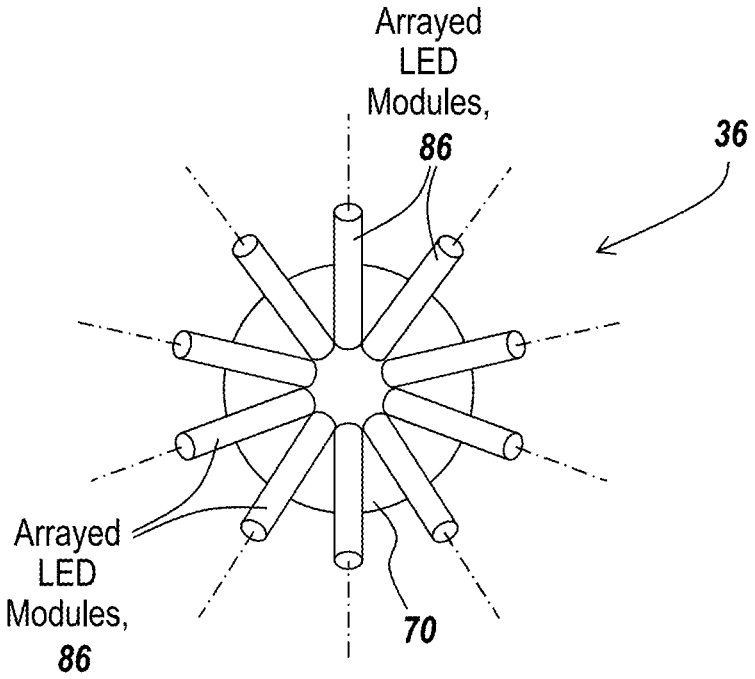
FIG. 7 is a diagrammatic illustration of the utilization of a number of LED modules mounted in a circle and aimed in different directions to provide 360° high intensity coverage for the mooring beacon of FIGS. 1, 2 and 3.

The mooring beacon 18 is provided with an on-off switch 60 such that the mooring beacon can be actuated when placed adjacent a mooring ball. The 360 degree high intensity light source 36 may be any suitable light source. For example, in some embodiments, the 360 degree high intensity light source 36 may be implemented with a strobe light or one or more light emitting diodes (LEDs). In some embodiments where a strobe light is used, the strobe light may be visible for a mile or more. Alternatively, and as shown in FIG. 7, the high intensity light source may be made of a plurality of LEDs mounted around the periphery of a circular support so that they face outwardly and provide 360 degree visibility. If the individual light emitting diodes are not sufficiently intense, they may be located in mini flashlight modules such that the light emitted in one direction is spread out by the number flash light modules. Note that each flashlight module may incorporate a number of LEDs. The LEDs may be programmed to blink in a strobe-like manner to be easily visible. The LEDs may be programmed to blink a finite number of times, such as not more than 5 blinks for a single activation. Controlling the blinking limits light pollution in the harbor.

Figure 5:
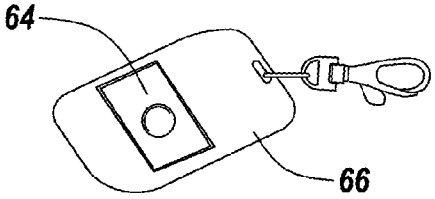
FIG. 5 is a diagrammatic illustration of a handheld wireless transmitter device for use by a mariner on a boat seeking to activate the mooring beacon of FIGS. 1, 2 and 3.

As illustrated in FIG. 5 a typical wireless transmitter device 62 is shown with an activation button 64 to cause the wireless transmitter device 62 to transmit a coded signal which is picked up by the mooring beacon 18. In some embodiments, wireless transmitter device 62 may be a remote control transponder, a mobile computing device application, or other suitable transmitter or transceiver.

Figure 6:
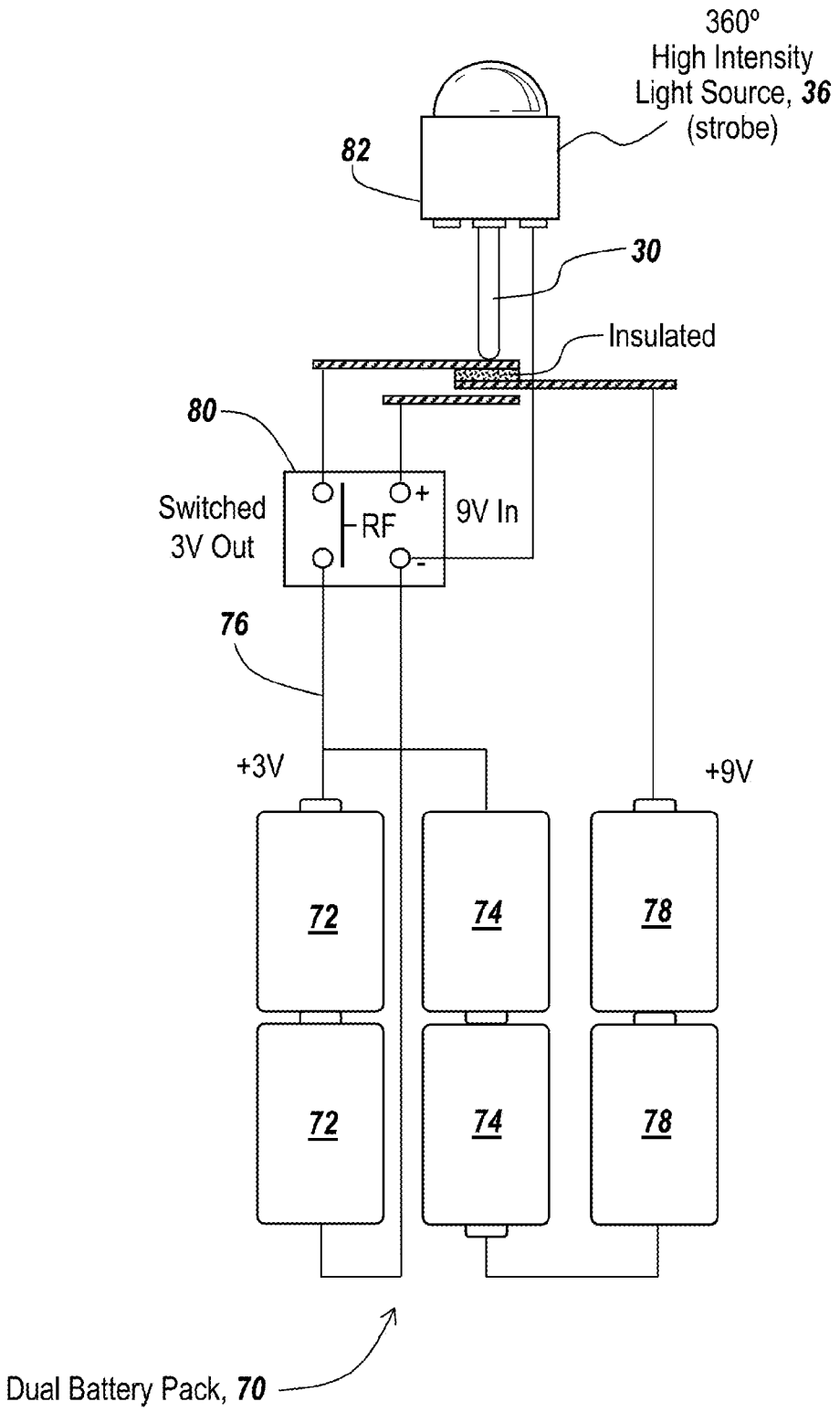
FIG. 6 is a diagrammatic illustration of a dual power source assembly for use in the mooring beacon of FIGS. 1, 2 and 3, showing a low voltage source to power the receiver in the mooring beacon and a higher voltage source to power a high intensity light source.

Referring now to FIG. 6, a dual battery pack 70 includes a pair of batteries 72 connected in series, the output of which is 3 V and a number of batteries 74 connected in series to produce a combined output of 9 V. The output from the low voltage source over is coupled to a switch module 80 which is activated by a receiver 34 (not shown in this figure) so that under normal operation the low-voltage 3 V is applied to a receiver 34 mounted atop the shaft 30.

When the mooring is actuated by a remote RF signal, switch module 80 connects the high-voltage from batteries 74 to power the high intensity light source 36. When this light source 36 is a strobe as illustrated, its power drain is significant and requires the higher voltage to sustain his high power output.

However, as illustrated in FIG. 7, if the high intensity light source 36 may be comprised of LED modules 86 each pointed in a different direction around a periphery, then the drain on battery 74 may be significantly reduced while at the same time providing for the required high intensity omnidirectional output. As mentioned above, if individual light emitting diodes mounted around the periphery of a support, for instance support 90, are insufficiently bright to provide visibility over long ranges, aggregates of LEDs may be mounted in modules to provide high intensity light in one direction. In this case a number of these modules may be arrayed around in a circle on support 90 such that while the beam width is relatively narrow for each of these modules, the use of multiple modules pointing in different directions permits omnidirectional high intensity light to be propagated out across the harbor.

Figure 8A:
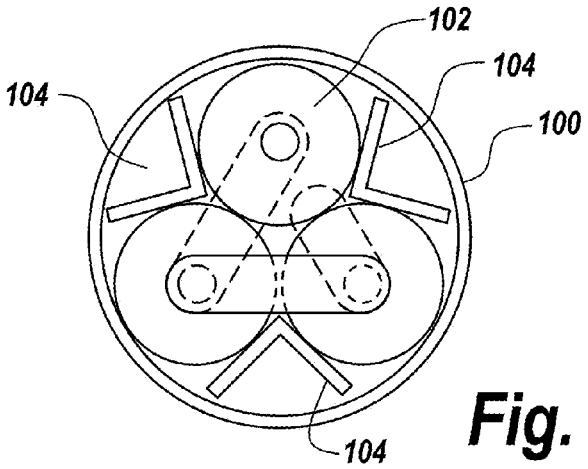
FIG. 8A is a top view of the location of batteries in a cylindrical housing for use in the battery package of FIG. 3.
Figure 8B:
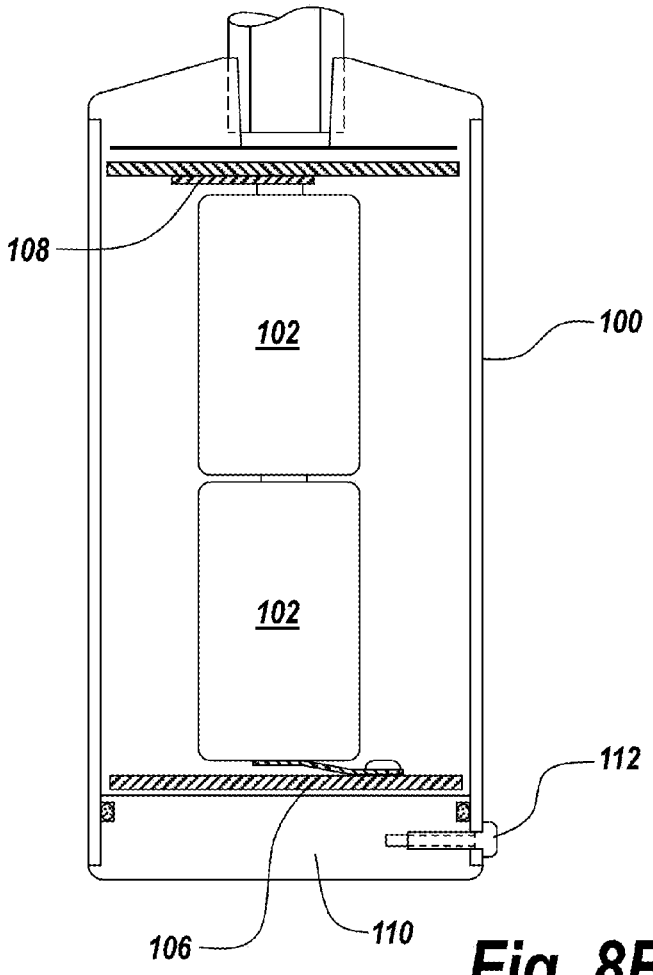
FIG. 8B is a side view of the placement of batteries within the battery package of FIG. 8A.

Referring now to FIG. 8A, in one embodiment, a housing 100 houses a number of cylindrical batteries 102 in a triangular configuration. The batteries are kept in place by spacers 104 so as to make sure they do not become dislodged. Referring to FIG. 8B, housing 100 is shown with batteries 102 mounted vertically within the housing and connected by contacts 106 and 108 to keep the batteries in place. The batteries may be replaced through a lower portion 110 of housing 100 which is anchored in place through a pin or screw 112. In another embodiment, a single battery may be utilized to power the mooring beacon 18, if sized properly. The battery or batteries forming the ballast of the mooring beacon 18 may be rechargeable and may be recharged from a connection port (not shown) mounted at an upper portion 50 of the shaft 30.

It will be appreciated that what is provided is a mooring beacon which floats next to a mooring ball and is tethered thereto such that the mooring beacon is actuated remotely by a wireless transmitter and is provided with a high intensity omnidirectional light source visible over large distances, thus to be able to identify the particular mooring for the boater seeking to moor his boat. In one embodiment, the receiver utilized to activate the high intensity light source turns off the high intensity light source after predetermined time so as to minimize power source (e.g., battery) drain.

With the power source located at the distal end of the shaft of the mooring beacon and since the power source must of necessity weigh enough to keep the mooring shaft vertically oriented, the power source is designed not only to ballast the mooring beacon but also to permit season-long usage of the mooring beacon without replacement. It is noted that for marine use, all of the above components are waterproof and sealed such that corrosion is avoided as well as internal shorting for the components of the mooring beacon.

While the above operation has been described in connection with mooring balls, it will be appreciated that the described devices may be attached to any suitable structure, including other types of moorings, docks, piers, floating docks, floating moorings, buoys, flags, poles, mooring sticks and/or pilings. The actuation of the mooring beacon is the same as discussed hereinbefore. Moreover, these mooring beacons can be actuated for instance by a mooring site manager, such as a dock master, harbormaster, yacht club manager, or marina manager, to indicate which of the mooring sites is available for use. In this case, the remote control unit is utilized to actuate a particular mooring beacon, which actuation is under the control of the mooring site manager instead of or in addition to the operator of the vessel.

Figure 9:
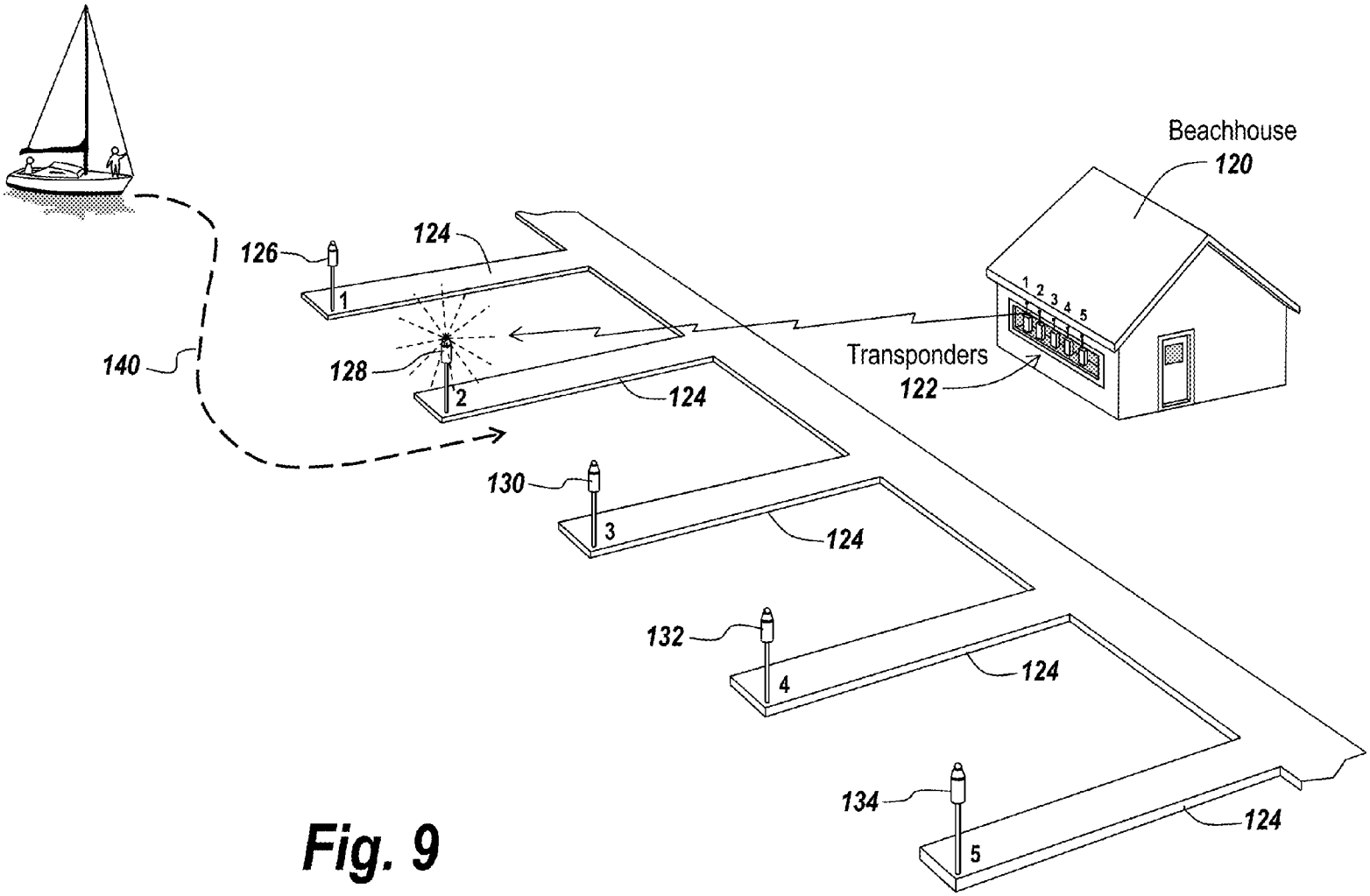
FIG. 9 is a diagrammatic illustration of the utilization of the subject remote controllable beacon to indicate which of a plurality of docks is indicated as being available for an incoming vessel under the control of a mooring site manager.

More particularly, and referring now to FIG. 9, it will be seen that a dock house 120 is provided with a number of wireless transmitter devices 122. In some embodiments, wireless transmitter devices 122 may include remote control transponders, mobile computing device applications, and/or other types of transmitters or transceivers. These wireless transmitter devices correspond to docks 1-5, with the wireless transmitter devices forming a head end control system and configured to actuate a corresponding high intensity light source at the end of the appropriate dock. Here a number of docks 124 are illustrated as being Docks 1, 2, 3, 4, 5. At the end of each of these docks is an illuminable remote-controllable light source on a pole such as indicated at 126, 128, 130, 132 and 134. When the mooring site manager wishes to indicate that the that Dock Number 2 is available, he activates the wireless transmitter device 122 corresponding to Dock Number 2, at which point the high intensity light source at 128 is illuminated to indicate the dock to which a boater is to tie up. Thus, the vessel travels along dotted line 140 to the near side of Dock Number 2 as illustrated.

In this manner, the mooring site manager can indicate which dock is available for an incoming vessel. In this case either the mooring beacon can be floated at the end of the dock or the shaft portion merely physically attached to the end of the dock, with the operation of the beacon being as mentioned hereinbefore.

Figure 10:
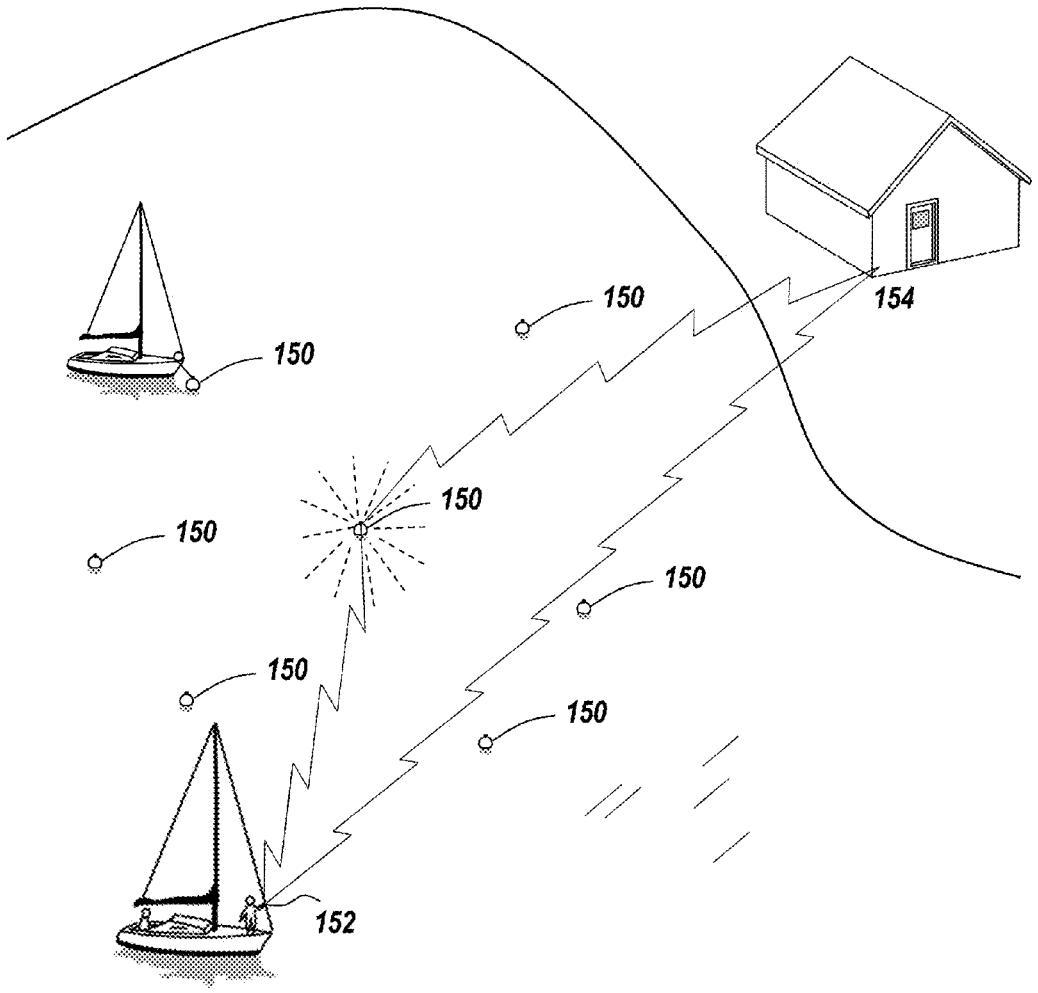
FIG. 10 is an illustration of an exemplary mooring site management system that includes a user device and a mooring site management device.

In some additional embodiments, a user may be able to wirelessly activate a particular mooring beacon using a different wireless transmitter device or another device. FIG. 10 illustrates an example mooring site management system that includes mooring sites 150, user device 152 and a mooring site management device 154. In some embodiments, mooring site 150 includes a mooring beacon 18 and/or a high intensity light source 128, as previously described. As shown in FIG. 10, the example mooring management system can be configured to permit user device 152 to transmit signal to an assigned mooring site 150. In some embodiments, user device 152 is also configured to transmit and receive signal from the mooring site management device 154. Similarly, the mooring site management device 154 can be configured to transmit signal to the mooring site 150 and configured to transmit and receive signal from the user device 152. Signal may be transmitted to and from user device 152 and mooring site management device 154 by any suitable method, including but not limited to Wi-Fi, Bluetooth, cellular, and other methods using radio frequency, light, and/or sound signals. In some embodiments, signal may be directly transmitted to and from user device 152 and mooring site management device 154, while in other embodiments, signal may be indirectly transmitted to and from user device 152 and mooring site management device 154. For example, in some embodiments, signal may be relayed through intermediary servers and/or satellites, as appropriate.

In some embodiments, mooring site management device 154 may be operated by a mooring site manager (e.g., dock master, harbormaster, yacht club manager, or marina owner), while in other embodiments, mooring site management device 154 may be at least partially automated. For example, in some embodiments, mooring site management device 154 may be configured to automatically send signal to user device 152 and/or mooring site 150. In some such embodiments, mooring site management device 154 may include a record of available mooring sites and, upon receiving a request from a user device 152 for a mooring site, may respond by illuminating a mooring beacon on a particular mooring site 150 and/or sending a signal (e.g., confirmation or denial of the mooring site request) to user device 152.

User device 152 and mooring site management device 154 may be implemented using any appropriate device. For example, remote control transponders, mobile computing device applications, or other types of transmitter or transceiver devices may be used for user device 152 and/or mooring site management device 154. In some embodiments, user device 152 and/or mooring site management device 154 may be implemented using a mobile computing device, such as a cellular telephone, a tablet, or a laptop computer. In some such embodiments, an application on the mobile computing device may be used to send and receive wireless signals to other devices, including user device 152, mooring site management device 154 and/or mooring site 150.

As described, in some example embodiments, user device 152 and/or mooring site management device 154 may be capable of activating a high intensity light source attached to mooring site 150. For example, in some embodiments, user device 152 and/or mooring site management device 154 may be capable of adjusting the color of the high intensity light source on mooring site 150. Similarly, in some embodiments, user device 152 and/or mooring site management device 154 may be configured to activate the high intensity light source on mooring 150 to flash in particular intervals, for example, in consistently timed bursts with the same amount of time between each burst or with varying amounts of time between each burst.

Example systems, such as that shown in FIG. 10 may allow various tasks to be performed using the user device 152, including but not limited to: reserving a mooring site, providing payment for the mooring site, viewing the mooring site on a map, illuminating the designated mooring site beacon, and/or communicating with the mooring site management device 154. In some embodiments, user device 152 includes additional features, such as geographic search capabilities, a catalogue of available mooring sites (including, for example, tackle description, boat size, type, last maintenance, etc.), commercial mooring areas, charter services, and the like. In some embodiments, user device 152 may need to be given access prior to being able to activate a beacon on mooring site 150. In some such embodiments, a user may request access to a mooring site, for example, by sending an appropriate signal to the mooring site management device 154, and after payment or upon approval from mooring site management device 154, the user device 152 may be permitted to send signal to mooring site 150. As will be understood, any of the disclosed techniques, devices, and/or systems may be combined, as desired. Numerous configurations and variations will be apparent in light of the subject disclosure.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A system for identifying a mooring site, the system comprising:

a plurality of mooring beacons, wherein each mooring beacon is assigned to a different mooring site, each mooring beacon including:

a receiver adapted to receive a wireless activation signal for activating a high intensity light source thereon, said mooring beacon fixedly attached to said mooring site; and a head end control device comprising a plurality of remote control devices for wirelessly transmitting said activation signal to said receiver to activate said high intensity light source, whereby the mooring site can be identified by activating a corresponding mooring beacon among the plurality of mooring beacons.

2. The system of claim 1, further comprising a plurality of remote control devices, wherein each remote control device is associated with one or more mooring beacon such that a particular mooring beacon may be activated by a corresponding remote control device.

3. A system for locating a mooring site, the system comprising:

a first mooring beacon configured to connect to the mooring site, the first mooring site comprising:

a central shaft of a mooring stick;

a ballast at the base of said shaft containing at least one power source which supplies the ballast for the mooring stick;

a float surrounding a middle portion of the mooring stick and located along said shaft between the top of said shaft and said ballast;

a 360 degree viewable high intensity light source on top of said shaft being daylight visible and activated by an activation signal;

an electronics package located on said shaft including a receiver that responds to a wireless frequency or a code for generating the activation signal, wherein the electronics package is configured to allow a user to program the high intensity light source to change from a first flash sequence to emit a second flash sequence, wherein the first flash sequence is different than the second flash sequence; and a conductor connected from the at least one power source in said ballast to said electronics package and light source for the powering thereof; and a first wireless remote control device configured to transmit the wireless frequency or code to generate the activation signal of the first mooring beacon.

4. The system of claim 3, further comprising a plurality of mooring beacons within a mooring field or a dock, wherein the first mooring beacon is among the plurality of mooring beacons and each mooring beacon is configured to be connected to a particular mooring site and each mooring beacon is configured to have a unique activation signal.

5. The system of claim 4, further comprising a plurality of wireless remote control devices, wherein the first wireless remote control device is among the plurality of wireless remote control devices, and each wireless remote control device is configured to transmit the wireless frequency or code to generate the unique activation signal of a particular mooring beacon to identify the particular mooring beacon among the plurality of mooring beacons.

6. The system of claim 4, further comprising a master wireless remote control device, wherein the master wireless remote control device is configured to transmit the wireless frequency or code to generate the unique activation signal of any mooring beacon among the plurality of mooring beacons.

7. The system of claim 6, wherein the wireless frequency or code is transmitted using cellular, Wi-Fi, Bluetooth, ZigBee, ultra-high frequency (UHF), or near-field communication (NFC) technology.

8. The system of claim 4, further comprising:

a plurality of wireless remote control devices, wherein the first wireless remote control device is among the plurality of wireless remote control devices, and each wireless remote control device is configured to transmit the wireless frequency or code to generate the activation signal of a particular mooring beacon from the plurality of mooring beacons; and a master wireless remote control device, wherein the master wireless remote control device is configured to transmit the wireless frequency or code to generate the unique activation signal of any mooring beacon among the plurality of mooring beacons.

9. The system of claim 3, wherein the first mooring beacon comprises:

the 360 degree viewable high intensity light source configured to emit light of at least a first color and a second color; and the electronics package receiver configured to receive a signal from the first wireless remote control to change the color of the first mooring beacon from the first color to the second color.

10. The system of claim 9, wherein the first wireless remote control device is configured to transmit the signal to the first mooring beacon to change the color of the first mooring beacon from the first color to the second color.

11. The system of claim 4, wherein the first flash sequence and second flash sequence of the first mooring beacon is different than a first flash sequence and a second flash sequence of any mooring beacon among the plurality of mooring beacons.

12. A system for managing a plurality of mooring sites, the system comprising:

a mooring site having an attached mooring beacon, the mooring beacon having a 360 degree viewable light source thereon and a receiver;

a mooring site management device for wirelessly transmitting an activation signal to said receiver to activate said high intensity light source; and a user device for sending and receiving signal to the mooring site management device and for wirelessly transmitting an activation signal to said receiver to activate said high intensity light source.

13. The system of claim 12, wherein the mooring site is a mooring ball, a mooring buoy, a mooring stick, a mooring piling, a fixed dock, a floating dock, a pier, a flag, or a pole.

14. The system of claim 12, wherein the activation signal is transmitted using cellular, Wi-Fi, Bluetooth, ZigBee, ultra-high frequency (UHF), or near-field communication (NFC) technology.

15. The system of claim 12, wherein the mooring beacon further comprises an electronics package that responds to the activation signal, wherein the electronics package is configured to allow a user to program the high intensity light source to change from a first flash sequence to emit a second flash sequence, wherein the first flash sequence is different than the second flash.

16. The system of claim 12, wherein the mooring site management device and the user device transmit and receive signal from one another.

17. The system of claim 12, wherein the user device is implemented using a mobile computing device application.

18. The system of claim 12, wherein the mooring site management device is configured to automatically respond to a signal from the user device.

* * * * *